US006624135B2

(12) United States Patent
Takano

(10) Patent No.: US 6,624,135 B2
(45) Date of Patent: Sep. 23, 2003

(54) CLEANING SHEET

(75) Inventor: Rumi Takano, Tokyo (JP)

(73) Assignee: S.C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 10/299,420

(22) Filed: Nov. 19, 2002

(65) Prior Publication Data

US 2003/0100470 A1 May 29, 2003

(51) Int. Cl.[7] ..... C11D 17/00; C11D 17/04; C11D 3/22; C11D 3/37

(52) U.S. Cl. ..... 510/438; 510/238; 510/422; 510/463; 510/491; 510/499; 510/501; 510/505

(58) Field of Search ..... 510/438, 238, 510/422, 463, 491, 499, 501, 505

(56) References Cited

U.S. PATENT DOCUMENTS

| | | | | |
|---|---|---|---|---|
| 5,013,485 A | | 5/1991 | Tsukuda et al. | 252/551 |
| 6,284,259 B1 | * | 9/2001 | Beerse et al. | 424/404 |
| 6,340,663 B1 | * | 1/2002 | Deleo et al. | 510/438 |
| 2002/0183233 A1 | * | 12/2002 | Mitra et al. | 510/438 |

FOREIGN PATENT DOCUMENTS

| | | | |
|---|---|---|---|
| JP | 06031416 | 4/1994 | C11D/3/60 |
| JP | 06296571 | 10/1994 | A47L/13/17 |
| JP | 10025492 | 1/1998 | C11D/1/65 |
| JP | 11256200 | 9/1999 | C11D/17/08 |
| JP | 2001115195 | 4/2001 | C11D/3/50 |
| JP | 2001329293 | 11/2001 | C11D/17/08 |

* cited by examiner

*Primary Examiner*—Necholus Ogden

(57) ABSTRACT

A cleaning sheet having high cleaning ability and with which finished quality of a surface after cleaning is excellent. A cleaning sheet comprising a sheet base material impregnated with an aqueous cleaning composition that has a pH value of 8 to 11, the composition comprising (A) at least one compound selected from monoethanolamine, morpholine and morpholine derivative compounds, (B) a saturated or unsaturated fatty acid having 14 to 22 carbon atoms, (C) a terpene-type hydrocarbon, and (D) a surfactant.

8 Claims, No Drawings

CLEANING SHEET

CROSS REFERENCES TO RELATED APPLICATIONS

This application claims priority to Japanese application number 2001-358936, filed Nov. 26, 2001.

STATEMENT REGARDING FEDERALLY SPONSORED RESEARCH

Not applicable.

BACKGROUND OF INVENTION

This invention pertains to a type of cleaning sheet. More specifically, this invention pertains to a type of cleaning sheet with high cleaning ability and excellent finished quality of the surface after cleaning.

Usually, for stains on a solid surface, as the time between contamination and cleaning becomes longer, attachment of the stain to the surface of the base material becomes stronger, so cleaning it becomes difficult. For example, for an oily stain attached to ventilating fans, kitchen walls, glass, refrigerators, etc., when it is left untouched for a long time, it oxidizes to a sticky modified oil. Oily stains that are difficult to clean, e.g., hand stains, gum stains, etc., may be present in other places in the home in addition to the kitchen.

Conventional detergents for removing said oily stains include detergents mainly made of inorganic strong alkaline agents, detergents mainly made of organic amines and water-soluble organic solvents, etc.

However, when said detergents are used as feed liquid, the finished quality (wiping trace, unevenness of wiping, tack, etc.) is problematic. For example, for an inorganic alkaline agent, because it is nonvolatile, wiping traces are left on the cleaned surface. As a result, the appearance is poor. When organic amines are used in place of inorganic alkaline agents, the surfactant added as an auxiliary agent is left as wiping traces on the cleaned surface. As a result, after application of the feed liquid, it is typically necessary to rinse it with a sufficient amount of water.

In particular, there is the following demand: when a detergent itself impregnated in a sheet base material is used, there is no need to perform further wiping or water rinsing after cleaning, and good finished quality is displayed.

In addition when a sheet impregnated with a highly alkaline detergent is used, the hands of the user may become roughened. When a sheet impregnated with a neutral detergent is used, it is necessary to increase the cleaning effect due to the sheet base material itself, so as to improve the effect of removing the stain.

On the other hand, terpene-type hydrocarbons have excellent detergency for oily stains. However, when the content of the terpene-type hydrocarbon contained in the detergent is small, no effect can be expected on detergency. When the content is too large, the odor becomes significant.

The objective of this invention is to solve the aforementioned problems of the conventional methods by providing a type of cleaning sheet that has high cleaning ability and excellent finished quality of the surface after cleaning.

SUMMARY OF THE INVENTION

It was found that when a prescribed type of amine-based compound and a prescribed type of fatty acid are added together with a surfactant to an aqueous detergent composition, and the aqueous detergent composition is impregnated in a sheet base material, a high cleaning ability can be displayed even in the weak alkaline region, and the surface after cleaning has excellent finished quality from the cleaning sheet. As a result, this invention was reached.

The invention relates to a type of cleaning sheet characterized by the fact that a sheet base material is impregnated with an aqueous detergent composition that has a pH of 8–11, and comprising (A) at least one, two or more compounds selected from monoethanolamine, morpholine and morpholine derivatives, (B) a saturated or unsaturated fatty acid having 14–22 carbon atoms, (C) a terpene-type hydrocarbon, and (D) a surfactant. The cleaning sheet may be characterized as follows: said component (A) may be 0.01–5 wt %, said component (B) may be 0.01–20 wt %, said component (C) may be 0.01–2 wt %, and said component (D) may be 0.1–10 wt %. Component (B) is preferably oleic acid. Component (C) is preferably limonene.

Although the mechanism of action of the aqueous cleaning composition impregnated in the cleaning sheet of this invention has not been fully clarified, it is believed that when a prescribed type of amine-based compound and a prescribed type of fatty acid are added, the formed amine soap can facilitate dissolution of the terpene-type hydrocarbon, and, because a surfactant is also added, even in the weak alkaline region, high cleaning ability still can be displayed, and excellent finished quality can be displayed for the surface after cleaning. Also, because weakly alkaline while a high cleaning ability is maintained as mentioned above, it has low irritancy to the skin of the hands of the user.

DETAILED DESCRIPTION

The cleaning sheet of this invention may be characterized as follows: a sheet base material is impregnated with an aqueous detergent composition that has a pH value of 8–11, and comprising (A) at least one, two or more compounds selected from monoethanolamine, morpholine and morpholine derivative compounds, (B) a saturated or unsaturated fatty acid having 14–22 carbon atoms, (C) a terpene-type hydrocarbon, and (D) a surfactant.

There is no special restriction on the type of the sheet base material for use in preparing the cleaning sheet of this invention. Examples that may be used preferably include nonwoven fabric, woven fabric, knitware, felt, paper, etc. In consideration of the productivity, manufacturing cost, ease of use, etc., it is preferred that a nonwoven fabric be used.

For the nonwoven fabric, in order to hold the aqueous cleaning composition in the sheet, it is preferred that it contain hydrophilic fibers. Also, in order to maintain the strength of the nonwoven fabric, it is preferred that it contain hydrophobic fibers.

Examples of hydrophilic fibers that may be used preferably include cotton, silk, and other natural fibers, rayon and other regenerated fibers, acetate and other semisynthetic fibers, polyvinyl alcohol fibers, acrylic fibers, other synthetic fibers, etc.

Examples of hydrophobic fibers that may be used preferably include nylon fibers, polyester fibers, polyolefin fibers (polyethylene, polypropylene, etc.) and other synthetic fibers.

The aforementioned types of fibers may be used either alone or as a mixture of several types.

The nonwoven fabric may be made of hydrophilic fibers alone, or hydrophobic fibers alone, or as a mixture of both types of fibers.

Concerning the state of the hydrophilic fibers and hydrophobic fibers contained in the nonwoven fabric, the hydrophilic fiber and hydrophobic fibers may be mixed to form a single-layer structure nonwoven fabric. Also, the nonwoven fabric may have a laminated structure composed of a layer made of hydrophilic fibers alone and a layer made of hydrophobic fibers alone.

When both hydrophilic fibers and hydrophobic fibers are used together (as either a single-layer structure or laminated structure), the ratio of the two types of fibers by weight is preferably in the range of 5:95~95:5, or more preferably in the range of 10:90~90:10.

Forms of fibers for forming the nonwoven fabric in this invention include the conventionally used single fibers, long fibers, as well as fibers with profiled cross sections, such as circular shape, elliptical shape, etc., composite fibers, very fine fibers, divided fibers, and other types of fibers. Among these forms, the very fine fibers and divided fibers are preferred in consideration of their stain- and dust-removing ability. Examples of very fine fibers include those made of polyester, nylon, polyethylene, polypropylene, acrylic resin, etc., with sizes in the range of 0.5–3 $\mu$m. Examples of divided fibers include polyester/nylon, polyester/polypropylene, polyethylene/polypropylene, etc.

The structure of the nonwoven fabric may be a monolayer or laminated structure having two or more layers. For the laminated structure, it is preferred that 2–3 layers be laminated. In this invention, the monolayer structure is especially preferred.

Preferable combinations of the materials of fibers in this invention include polypropylene/rayon mixture, polyethylene/rayon mixture, polyester/rayon mixture, polypropylene/cotton mixture, rayon/nylon/polyester mixture, etc.

The size of the sheet base material may be selected appropriately corresponding to the specific application purpose. The amount of the aqueous detergent composition impregnated in the sheet base material is preferably in the range of 50–700 wt %, or more preferably in the range of 100–300 wt %, with respect to the weight of the sheet base material.

Examples of component (A) include monoethanolamine, morpholine, and morpholine derivatives. Among these, monoethanolamine and morpholine are especially preferred.

The content of said component (A) is preferably in the range of 0.01–5 wt %, or, from the standpoint of further facilitating dissolution of the terpene-type hydrocarbon, more preferably in the range of 0.1–2 wt %.

According to this invention, as long as the effects of this invention are not degraded, it is possible to add a third component, e.g., ammonia, diethanolamine, triethanolamine, diethylaminoethanol, etc.

Component (B) is a C14–22 saturated or unsaturated fatty acid, e.g., myristic acid, tetradecenoic acid, hexadecenoic acid, oleic acid, linolic acid, linolenic acid, etc. Among these, from the standpoint of facilitating dissolution of the terpene-type hydrocarbon, the unsaturated fatty acids are preferred. Among these, in consideration of ease of procurement, low price for industrial use, etc., oleic acid is especially preferred.

The content of said component (B) is preferably in the range of 0.01–20 wt %. In consideration of promotion of wetting of the stain and better finished quality, the content is more preferably in the range of 0.01–5 wt %, or most preferably in the range of 0.01–1 wt %.

From the standpoint of balancing the amine soap, the mixing ratio of said component (A) and component (B), component (A):component (B) is preferably in the range of 0.1~10:1 (by weight).

Component (C) is a terpene-type hydrocarbon. It can display a synergic effect with said component (A) and component (B) to improve the detergency. From the standpoint of imparting sufficient detergency, the content of said component (C) is preferably in the range of 0.01–2 wt %, or more preferably in the range of 0.1–2 wt %.

Examples of component (C) include D- and L-limonene (contained in orange oil, lemon oil, etc.), $\alpha$-pinene (contained in turpentine oil, etc.), $\alpha$-terepineol and other monoterpene-based hydrocarbons (contained in pine oil, etc.), caryophyllene, cedrene, and other sesquiterpene-based hydrocarbons (contained in large amounts in cedar oil, clove oil, and canaga oil), etc. Among these, from the standpoint of excellent detergency for oily stains and fragrant odors favored by users, D- or L-limonene is especially preferred.

Component (D) is a surfactant. By containing it in the aqueous detergent composition impregnated in the cleaning sheet of this invention, emulsification, dispersion and dissolution of the terpene-type hydrocarbon as said component (C) are improved, thus the cleaning effect can be improved.

Said component (D) of this invention does not contain the amine soap formed from said component (A) and component (B).

The content of said component (D) is preferably in the range of 0.1–10 wt %, or more preferably in the range of 0.1–1 wt %.

There is no special restriction on the type of surfactant for use in this invention. Any nonionic surfactant or anionic surfactant may be used. Among these, a nonionic surfactant is more preferred. The surfactants may be used either alone or as a mixture of several types.

More specifically, examples of said nonionic surfactants include polyoxyethylene long-chain alkyl ethers and polyoxyethylene alkyl phenyl ethers with ethylene oxide adduct molar number of 6–35 and alkyl chain carbon number of 5–22, fatty acid diethanolamides, alkyldimethylamine oxides, etc. Among these, from the standpoint of facilitating dissolution of the terpene-type hydrocarbon and excellent cleaning ability, polyoxyethylene long-chain alkyl ethers are more preferred.

According to this invention, by using fatty acid diethanolamide, alkyl dimethylamine oxide, etc., it is possible to have a composition with even better foaming property and ability to prevent dripping of the detergent when it is applied on a vertical plane.

Examples of said anionic surfactants include alkyl ether sulfate salts, polyoxyethylene alkyl ether sulfate salts with ethylene oxide adduct molar number of 1–6 (or preferably 2–4) and alkyl chain carbon number of 5–22 (or preferably 5–18, or more preferably 8–14), alkylbenzene sulfonate salts, etc. Among these, from the standpoint of cleaning ability, alkyl ether sulfate salts are more preferred.

From the standpoint of high cleaning ability, low irritancy, and suppression of damage to styrene-based resin or other plastic-based material, the pH of the aqueous detergent composition in this invention is preferably in the range of 8–11, and more preferably in the range of 10–11.

According to this invention, in order to maintain the liquid property at a low temperature or high temperature, to increase the commercial added value of the product, to control the various properties, etc., various conventional additives may be added. Examples of additives that may be added include various types of low-temperature stabilizers, metal ion blocking agents, spices, dyes, pigments, preservatives, bactericides, alcohol, water-soluble solvents, etc. Also, according to this invention, in order to further improve the cleaning ability, it is preferred that alcohol be added. More specifically, ethanol is a preferable type of alcohol for use in this case.

The cleaning sheet of this invention can be used in various cleaning applications. In particular, it can be used preferably as a cleaning sheet for bathrooms, kitchens, living rooms, and other residential areas.

EXAMPLES

In the following, this invention will be explained in detail with reference to application examples. However, this invention is not limited to these application examples.

4 g of each aqueous detergent composition having composition listed in Tables 1 and 2 were impregnated in a nonwoven fabric (rayon/nylon/polyester fibers (30/35/35, weight ratio), monolayer structure, length of 14 cm×width of 22 cm, basis weight of 50 g) to form a cleaning sheet. The following methods were adopted to determine the cleaning ability for oily stains, and finished quality.

1. Test of Cleaning Ability for Oily Stain (A)

0.3 g of commercially available lard was uniformly coated on a 30 cm×30 cm glass panel to form a model of an oily stain. Each said cleaning sheet was used to wipe the oily stain model 10 times, and the effect of removing the stain was evaluated by visual observation. The results are listed in Tables 1 and 2.

Evaluation standards

◎ Stain is removed completely.
O ¾ or more of the stain is removed.
Δ About half of the stain is removed.
X Stain is not removed at all.

2. Test of Cleaning Ability for Oily Stain (B)/Finished Quality

Each of 20 families performed the following test: a gas range was used for 1 week without cleaning, then said cleaning sheet was used to lightly wipe off the stains. The degree of removal of the oily stains and the finished quality were visually evaluated with the following evaluation standards. Tables 1 and 2 list the results of most answers in said evaluation.

Evaluation standard 1 (cleaning ability)

O: Stain is removed almost completely.
Δ: About half of the stain is removed.
X: Little of the stain is removed.

Evaluation standard 2 (finished quality)

O: Few wiping traces are left.
Δ: Some wiping traces are left.
X: Wiping traces are left.

TABLE 1

| | Application Examples | | | | |
|---|---|---|---|---|---|
| Composition | 1 | 2 | 3 | 4 | 5 |
| Morpholine | 0.5 | 0.05 | 0.1 | 0.1 | 0.1 |
| Monoethanolamine | — | — | — | 0.5 | 0.5 |
| Oleic acid | 1 | 0.1 | 0.2 | 0.2 | 0.2 |
| D-limonene | 0.5 | 0.5 | 0.1 | 0.1 | 0.1 |
| Polyoxyethylene lauryl ether | 0.5 | 1 | 0.5 | 0.5 | 0.5 |

TABLE 1-continued

| | Application Examples | | | | |
|---|---|---|---|---|---|
| Composition | 1 | 2 | 3 | 4 | 5 |
| Ethanol | — | — | — | — | 10 |
| Purified Water | Balance | Balance | Balance | Balance | Balance |
| pH (adjusted with NaOH, HCl) | 10 | 10 | 10 | 10 | 10 |
| Sheet for impregnation of the detergent composition (nonwoven fabric) | Rayon/nylon/polyester fibers (30/35/35) | | | | |
| Oily stain cleaning ability (A) | O | O | O | O | ◎ |
| Oily stain cleaning ability (B) | O | O | O | O | O |
| Finished quality | O | O | O | O | O |

TABLE 2

| | Comparative Examples | | | | |
|---|---|---|---|---|---|
| Composition | 1 | 2 | 3 | 4 | 5 |
| Morpholine | 2 | — | — | 0.1 | 0.1 |
| Monoethanolamine | — | — | — | — | 0.5 |
| Oleic acid | — | 0.1 | — | 0.2 | 0.2 |
| D-limonene | 0.5 | 0.5 | 0.5 | — | — |
| Polyoxyethylene lauryl ether | 1 | 1 | 5 | 1 | 1 |
| Ethanol | — | — | — | — | 5 |
| Purified Water | Balance | Balance | Balance | Balance | Balance |
| pH (adjusted with NaOH, HCl) | 10 | 10 | 10 | 10 | 10 |
| Sheet for impregnation of the detergent composition (nonwoven fabric) | Rayon/nylon/polyester fibers (30/35/35) | | | | |
| Oily stain cleaning ability (A) | X | X | X | X | X |
| Oily stain cleaning ability (B) | X | X | X | X | X |
| Finished quality | X | X | X | X | Δ |

The results listed in Tables 1 and 2 show that the cleaning sheet of this invention has excellent oily stain cleaning ability and finished quality.

This invention provides a type of cleaning sheet with high cleaning ability and excellent finished quality of the surface after cleaning.

What is claimed:

1. A cleaning sheet comprising a sheet base material impregnated with an aqueous cleaning composition having a pH of 8 to 11, the cleaning composition comprising (A) at least one compound selected from the group consisting of monoethanolamine, morpholine, and morpholine derivative compounds;

(B) a saturated or unsaturated fatty acid having 14 to 22 carbon atoms;

(C) a terpene-type hydrocarbon; and (D) a surfactant.

2. The cleaning sheet according to claim 1, wherein component (A) is 0.01 to 5 weight % of the cleaning composition, component (B) is 0.01 to 20 weight %, component (C) is 0.01 to 2 weight % and component (D) is 0.1 to 10 weight %.

3. The cleaning sheet according to claim 1 wherein component (B) is oleic acid.

4. The cleaning sheet according to claim 2 wherein component (B) is oleic acid.

5. The cleaning sheet according to claim 1 wherein component (C) is limonene.

6. The cleaning sheet according to claim 2 wherein component (C) is limonene.

7. The cleaning sheet according to claim 3 wherein component (C) is limonene.

8. A cleaning sheet comprising a sheet base material impregnated with an aqueous cleaning composition having a pH of 8 to 11, the cleaning composition comprising: 0.01 to 5 weight % of at least one compound selected from the group consisting of monoethanolamine, morpholine, and morpholine derivative compounds;

0.01 to 20 weight % oleic acid;

0.01 to 2 weight % limonene; and 0.01 to 10 weight % a surfactant.

* * * * *